US005246661A

United States Patent [19]

Culling

[11] Patent Number: 5,246,661

[45] Date of Patent: Sep. 21, 1993

[54] EROSION AND CORRSION RESISTANT ALLOY

[75] Inventor: John H. Culling, St. Louis, Mo.

[73] Assignee: Carondelet Foundry Company, St. Louis, Mo.

[21] Appl. No.: 984,709

[22] Filed: Dec. 3, 1992

[51] Int. Cl.[5] ..... C22C 38/08; C22C 38/22

[52] U.S. Cl. ..... 420/12; 420/52; 420/101; 420/582

[58] Field of Search ..... 420/12, 52, 101, 584, 420/45, 46, 47, 51

[56] References Cited

U.S. PATENT DOCUMENTS 3,859,083 1/1975 Kusaka et al. ..... 420/52
4,363,660 12/1982 Wakita et al. ..... 420/12

FOREIGN PATENT DOCUMENTS 48-59012 8/1973 Japan ..... 420/12
59-43851 3/1984 Japan ..... 420/12
64-57998 3/1989 Japan ..... 420/584

*Primary Examiner*—R. Dean
*Assistant Examiner*—Sikyin Ip
*Attorney, Agent, or Firm*—Senniger, Powers, Leavitt & Roedel

[57] ABSTRACT

Air-meltable, castable, machinable, hardenable alloys that are very resistance to highly corrosive and abrasive slurries or fluids consisting essentially of, by weight, about 25% to about 37% chromium, about 12% to about 35% nickel, about 2% to about 7% molybdenum; about 1.3% to about 2% carbon, up to about 3% silicon, up to about 3% copper, up to about 4% manganese, up to about 1.5% tungsten, up to about 1% niobium, (columbium) and balance essentially iron plus the usual minor impurities.

14 Claims, No Drawings

EROSION AND CORRSION RESISTANT ALLOY

This invention relates to ferrous metal alloys composed and structured so as to be superior to stainless steels and cast "white" irons for many applications where both corrosion and erosion of the metal may occur.

BACKGROUND OF THE INVENTION

Ferritic stainless steels have excellent resistance to some strongly oxidizing substances but are quite soft and subject to rapid erosion or abrasion. Martensitic stainless steels may be produced in a hard state but have very limited corrosion resistance and have not performed well in most abrasive slurries. Austenitic stainless steels and irons resist the chemical attack of a wide spectrum of corrosive substances, however, they are relatively soft metals and are rapidly abraded or eroded in fluids which contain abrasive particles or even vapor bubbles.

While certain highly modified stainless alloys have been developed to handle various strengths of sulfuric acid, they are quite soft and abrade rapidly in erosive slurries containing hard particles and/or air bubbles. A minimum of about 350 to 400 Brinell Hardness number (BHN) has been found to be required for good abrasion resistance to most slurries.

White cast irons, particularly those of largely martensitic matrices, have been employed for decades in applications involving dry or wet abrasive substances. Many fluids or slurries, such as highly acidic slurries, are both abrasive and corrosive to metal parts designed to handle them and low to medium alloy white cast irons are rapidly attacked by most corrosive slurries.

Under certain conditions of combined corrosion and abrasion, high carbon high chromium cast irons have been widely employed since about 1930. For example, high chromium cast irons with chromium contents over 20% give excellent resistance to nitric acid up to about 66% acid strength at room temperature and up to about 37% acid strengths to the boiling temperature. They are also useful in phosphoric acid concentrations up to about 45%, in sodium hydroxide up to 15%, ammonium nitrate or sulphate up to 50% and several other types of corrosive substances. They do not have useful resistance to sulfuric acid of any strength up to 60%. They could be employed in cold concentrated sulfuric acid but offer no advantage over ordinary plain gray cast iron in this service. High chromium irons typically contain about 2.5% carbon, 28% chromium and no nickel. In the as cast condition castings of these irons typically range from about 450 to 580 Brinell Hardness numbers (BHN). These irons may be slightly softened for improved machinability by annealing heat treatments and when machining is finished, may be given different heat treatments for improved abrasion resistance and hardnesses of up to about 550 to 700 BHN.

Heyer, et al. U.S. Pat. No. 4,080,198, discloses an iron which nominally contains 1.6% C, 28% Cr, 2% Mo, 2% Ni, up to 1% Cu and the balance substantially iron plus small amounts of impurities or tramp elements. This alloy is claimed to have corrosion-erosion resistance superior to the nickel-free, higher-carbon alloys described above in acidic or saline slurries. Khandros, et al., U.S. Pat. No. 4,536,232, discloses an iron of the same chemical composition described by Heyer et al., but is said to have greatly improved corrosion and erosion resistance over the '198 alloy in 20% aluminum slurries of 0.75 pH due to the addition of 2.5% sulfuric acid. The improvement is said to have been obtained by a special heat treatment, i.e., double tempering at about 1400° F. This alloy, whether heat treated according to the '198 patent or according to the '232, or left in the as-cast state, is always composed of large amounts of carbides precipitated in and around grains of mixed matrix structure, which are principally magnetic and of body center cubic crystal cell formation. Machining is quite difficult regardless of heat treatment.

The microscopic carbide particles of high carbon alloys have hardnesses of about 1700 to 1800, as measured by the pointed diamond pyramid method. However, the Brinell Hardness test employs a 10 mm diameter hard ball which takes into account the effect of the hard carbides and the soft matrices of these alloys in which the carbides are embedded. While the carbides provide abrasion resistance in high carbon alloys, it is well established that microscopic soft matrix areas between the hard carbide particles must have good resistance to whatever corrosive substances might be present in the slurries, if long alloy life is to be realized.

Niu Hong-jun, et al., in "Heat-Resisting Materials, Proceedings of the First International Conference," Fontana, Wisc., USA/Sep. 23–26, 1991, pp. 269–274, discloses an alloy having a composition by weight percentages, of 1.5% C, 18.2% Cr, 6.9% Ni, 2.5% Mo, 2.6% Si, 0.99% Mn, 0.16% P, 0.035% S and the balance substantially iron. The structure of this alloy as cast is composed of carbides and austenite (face center cubic crystal structure matrix). The alloy was developed for corrosion resistance, wear resistance and hot hardness as an automotive engine valve seat insert material.

Certain cobalt base alloys have demonstrated good resistance to both the abrasion and corrosion encountered in handling some corrosive slurries. However, cobalt is quite scarce and far too expensive for the large tonnages of pumps and other parts required in the handling of corrosive industrial slurries. Aside from the economically impractical cobalt base alloys, stainless steels and similar alloys have good corrosion resistance but very poor abrasion resistance, while non-austenitic high alloy cast irons have excellent abrasion resistance but very limited corrosion resistance. The high-carbon austenitic steel of Niu Hong-jun, et al., has good abrasion resistance but very limited corrosion resistance. Thus there has remains a great need for alloys of reasonable cost that are able to resist both the abrasion and corrosion of chemically aggressive slurries and similar fluids and which do not require that articles cast from such alloys undergo extensive and expensive heat treatment.

SUMMARY OF THE INVENTION

Among the several objects of the present invention, therefore, may be noted the provision of alloys resistant to corrosive attack by a broad spectrum of chemical substances present in corrosive slurries and erosion from hard particulate matter in such slurries; the provision of such alloys that have only moderate hardnesses as cast and that may therefore be readily machined; the provision of such alloys that may, after machining, be fully hardened by simple, relatively low temperature aging heat treatment; the provision of such alloys that may be easily formulated from the readily available elements, iron, nickel, chromium, molybdenum, carbon and the usual deoxidizers commonly employed in steelmaking practice; and the provision of such alloys that may be easily and economically melted and cast in air.

Briefly, therefore, the present invention is directed to air-meltable, castable, machinable, hardenable alloys that are very resistance to highly corrosive and abrasive slurries or fluids. The instant alloys consist of, by weight, about 25% to about 37% chromium, about 12% to about 35% nickel, about 2% to about 7% molybdenum; about 1.3% to about 2% carbon, up to about 3% silicon, up to about 3% copper, up to about 4% manganese, up to about 1.5% tungsten, up to about 1% niobium, (columbium) and balance essentially iron plus the usual minor impurities.

DESCRIPTION OF THE PREFERRED EMBODIMENT

In accordance with the present invention, alloys are provided which have excellent resistance to fluid corrosion and abrasion.

The nickel content of the alloys of the invention is always chosen with respect to the other elements present so that the alloys are always composed of carbides imbedded in a matrix of austenite, i.e., metal of face center cubic crystal structure. When the alloys of the invention are rapidly cooled from the melt or from high heat treating temperature, the carbides will comprise about 15% of their total weight. After very slow cooling from the metal or upon aging for periods of several hours or longer at temperatures from about 700 to 1600° F., virtually the entire carbon content of alloys of the invention will be combined in carbides that then comprise about 24% of the total alloy weight.

Since large amounts of the chromium content of high carbon alloys are combined in the carbides, the amount of chromium remaining in the matrix to help provide corrosion resistance is severely reduced. Also, since the alloys of the invention are aged to provide high hardnesses that resist slurry abrasion, the morphology and matrix chemical composition of the aged alloys are very important. In high carbon alloys chromium contents of about 6 to 10 times the carbon content by weight may be present in the carbides.

The Niu alloy of 18.2% chromium would likely contain only about 11% chromium in the matrix after aging which would explain why this alloy was readily attacked in most of the tests discussed below. Contrariwise, the alloys of the present invention, which performed quite well in the same tests, would typically contain approximately 18% chromium in the matrix (at 1.5% carbon) after aging for maximum hardness. In practice, their compositions may be so chosen as to provide 20% chromium or more and as much as about 6% molybdenum remaining in the matrix even after aging to precipitate the maximum quantities of carbides.

Recycling of scraps, trimmings, used metallic parts, borings, turnings and similar materials is becoming increasingly important. Accordingly, several of the test alloys made in accordance with the invention were formulated to contain amounts of elements from the group tungsten, niobium and cobalt, which are frequently encountered in purchased scraps or returns. From these tests, it is apparent that alloys of the invention may contain up to about 1.5% W, up to about 1.5% Co and up to about 1% Nb without apparent detriment to corrosion resistance.

Phosphorus may be added in amounts up to about 0.4% by weight to aid in the precipitation hardening process, but it may be somewhat detrimental in some corrosive solutions. Therefore, when employed, about 0.1% to 0.25% is preferred. Silicon and manganese are commonly employed in steelmaking practice as deoxidizers. Up to about 3% Si and up to about 4% Mn may be employed without detriment to alloys of the invention. Copper has been employed in many alloys to enhance resistance to many corrosive substances such as sulfuric acid concentrations below about 25% and above 70%. Alloys of the present invention, which retain up to at least 3% Cu in solid solution, have greatly enhanced resistance to sulfuric acid solutions of up to at least 40 percent by volume, or 55 percent by weight when copper is present in amounts as small as about 0.75% by weight.

For relatively low cost and resistance to a broad spectrum of corrosive substances and slurries that is far superior to that of prior art erosion resistant alloys, the following ranges of elements in alloys of the present invention have been found to be especially desirable and economical:

| | |
|---|---|
| CHROMIUM | 25 TO 30% BY WEIGHT |
| NICKEL | 12 TO 17% |
| MOLYBDENUM | 2 TO 4% |
| CARBON | 1.4–1.8% |
| MANGANESE | UP TO ABOUT 4% |
| SILICON | UP TO ABOUT 2.5% |
| PHOSPHORUS | UP TO ABOUT 0.4% |
| IRON | ESSENTIALLY THE BALANCE |

For some applications it is preferable for alloys of the invention to have a very low phosphorus content, especially those alloys formulated with elements in the ranges set forth immediately above, i.e., a maximum of about 0.025% phosphorus.

For excellent resistance to sulfuric acid concentrations up to at least 40 volume percent (55 weight percent) in various erosive or abrasive slurries, it has been found desirable to formulate alloys of the invention with the following ranges of elements:

| | |
|---|---|
| CHROMIUM | 26 TO 30% BY WEIGHT |
| NICKEL | 13 TO 35% |
| MOLYBDENUM | 2 TO 4% |
| CARBON | 1.4–1.8% |
| COPPER | 0.75 TO 3% |
| MANGANESE | UP TO ABOUT 2% |
| SILICON | UP TO ABOUT 2.5% |
| COBALT | UP TO 1.5% |
| TUNGSTEN | UP TO 1.5% |
| NIOBIUM | UP TO 1% |
| PHOSPHORUS | UP TO ABOUT 0.25% |
| IRON | ESSENTIALLY THE BALANCE |

For excellent resistance to erosion in abrasive slurries containing hot chlorides and/or very corrosive substances, the maximum corrosion resistance in alloys of the invention has been found to be achieved by formulating them with the following ranges of elements:

| | |
|---|---|
| CHROMIUM | 32 TO 37% BY WEIGHT |
| NICKEL | 21 TO 30% |
| MOLYBDENUM | 3 TO 6% |
| COPPER | UP TO 1% |
| NIOBIUM | UP TO 1% |
| TUNGSTEN | UP TO 1% |
| MANGANESE | UP TO 1.5% |
| SILICON | UP TO 1.5% |
| CARBON | 1.4 TO 1.8% |
| PHOSPHORUS | UP TO ABOUT 0.25% |

-continued

| IRON | ESSENTIALLY THE BALANCE |
|---|---|

EXAMPLE 1

Heats of several different alloys were prepared in accordance with the invention. Corrosion test blocks of each alloy measuring 2.5 inches long by 1.25 inches wide by 0.4 inch thick were cast in dry sand molds. The composition of these alloys is set forth in Table I with the balance in each case being essentially iron.

TABLE I

ALLOYS OF THE INVENTION
COMPOSITION BY WEIGHT PERCENTAGES

| ALLOY NO. | Cr | Ni | Mo | C | Mn | Si | Cu | W | Nb | Co | P |
|---|---|---|---|---|---|---|---|---|---|---|---|
| H-995 | 26.51 | 18.23 | 2.57 | 1.68 | .50 | .99 | — | — | — | — | .02 |
| H-997 | 27.38 | 13.56 | 2.28 | 1.71 | .54 | 1.03 | .96 | — | — | — | .02 |
| H-1001 | 34.08 | 22.16 | 2.51 | 1.68 | .89 | .58 | — | — | — | — | .18 |
| H-1003 | 29.11 | 17.03 | 3.53 | 1.64 | 1.77 | .48 | 2.46 | — | — | — | .12 |
| H-1005 | 25.53 | 14.02 | 3.97 | 1.31 | 3.48 | .18 | .82 | — | — | — | .01 |
| H-1006 | 28.89 | 16.93 | 3.04 | 1.51 | .76 | .78 | 2.48 | — | — | — | .08 |
| H-1007 | 27.97 | 12.02 | 2.03 | 1.48 | 3.97 | .34 | 1.03 | — | — | — | .23 |
| H-1008 | 25.16 | 17.11 | 6.02 | 1.49 | .99 | 2.58 | — | — | — | 1.43 | .03 |
| H-1009 | 34.13 | 21.88 | 2.04 | 1.52 | 1.06 | .72 | 1.78 | — | — | — | .15 |
| H-1010 | 27.93 | 23.89 | 6.56 | 1.43 | .88 | .76 | — | — | — | — | .02 |
| H-1011 | 34.86 | 25.54 | 3.11 | 1.42 | .68 | .85 | 2.08 | 1.23 | — | .83 | .02 |
| H-1012 | 35.28 | 27.30 | 4.54 | 1.48 | .68 | .83 | — | — | 1.01 | .65 | .16 |
| H-1013 | 35.02 | 21.24 | 2.03 | 1.51 | 3.33 | .58 | 2.82 | — | — | — | .15 |
| H-1014 | 35.13 | 27.96 | 6.22 | 1.53 | .98 | .82 | .88 | — | — | .45 | .16 |

Heats of several alloys not of the invention were also prepared and cast in blocks of the same size. The composition of these alloys is set forth in Table II.

TABLE II

ALLOYS NOT OF THE INVENTION
COMPOSITION BY WEIGHT PERCENTAGES

| ALLOY DESIGNATION | Cr | Ni | Mo | C | Mn | Si |
|---|---|---|---|---|---|---|
| PACE/SPA | 28.03 | 2.13 | 2.06 | 1.57 | .72 | .91 |
| Niu | 18.21 | 6.93 | 2.51 | 1.52 | 1.01 | 2.63 |
| CF177 HiCr | 34.13 | — | — | 2.28 | .83 | 1.15 |
| H-987 | 27.84 | 5.02 | 5.42 | 1.59 | .52 | .89 |

The alloys produced in accordance with U.S. Pat. No. 4,080,198 and marketed under the trade name SPA has the same nominal composition as that of U.S. Pat. No. 4,536,232 and marketed under the trade name PACE, with the difference being that the latter alloy is given a double tempering heat treatment by air cooling from a four hour period at 1400° F. followed by a repetition of the same heat treatment.

Therefore, some test samples of the alloy prepared in accordance with the '232 patent were heat treated by the 1400° F. double temper process of the '232 patent. Alloy H-897 was also so heat treated.

Some test samples of the alloy designated as CF177 HiCr were heat treated by holding four hours at 2000° F. and then cooled in air.

Some test specimens from each of the other alloys were given an aging heat treatment of sixty hours at 1200° F. followed by cooling in air. The alloy designated as Niu was formulated to equal that reported by Niu Hong-jun, et al., but the 960 hour heat treatment at 1200° F. of those workers was not followed.

The Brinell Hardness numbers for test blocks of the alloys in Tables I and II in the as cast state as well as in the heat treated state are set forth in Table III.

TABLE III

| | BRINELL HARDNESS NUMBER | |
|---|---|---|
| | AS CAST | HEAT TREATED |
| H-995 | 269 | 373 |
| H-997 | 321 | 383 |
| H-1001 | 365 | 485 |
| H-1003 | 335 | 465 |
| H-1005 | 278 | 320 |
| H-1006 | 295 | 455 |
| H-1007 | 335 | 468 |
| H-1008 | 295 | 455 |
| H-1009 | 345 | 465 |
| H-1010 | 325 | 435 |
| H-1011 | 345 | 460 |
| H-1012 | 355 | 480 |
| H-1013 | 325 | 470 |
| H-1014 | 375 | 515 |
| PACE | 321 | 380 |
| Niu | 320 | 430 |
| H-987 | 387 | 485 |
| CF177 HiCr | 345 | 575 |

Since the alloys of concern require some machining of most castings intended for slurry handling service, test blocks from alloys of the invention along with those from all comparative alloys, except for H-987, were checked for machinability in the as cast state by drilling through the casting with a ⅜" diameter cemented-carbide-tipped drill bit. This particular bit was used since pump manufacturers and those who produce industrial equipment employing alloys of the erosion resistant type are accustomed to using cemented carbide and ceramic cutting tools because of the difficulty in machining these relatively hard substances. H-987 could not be drilled. The PACE alloy could be drilled in the as cast condition only at low speed and with the use of cutting fluid. However, the alloys of the present invention have better machinability at any hardness level than the prior art non-austenitic alloys. This point is illustrated by the fact that alloys of the invention of less than about 340 BHN in the as cast condition (H-997, H-1010 and H-1013, all of 321 to 325 BHN) could be drilled by ordinary ¼ inch diameter high speed tool steel bits, whereas the prior art PACE alloy, having about the same hardness as those alloys of the invention, immediately blunted the high speed drill bits and could not be drilled except by the cemented carbide bits. Obviously, there are cost saving advantages in using alloys of the invention since they can be machined in the as cast state without expensive heat treatment, pre-machining, preparation. On the other hand, from inspection of the hardness data in Table III it is evident that the alloys of the invention will have good abrasion resistance in corrosive/abrasive slurries.

EXAMPLE 2

While erosion resistant castings are typically machined in some areas of the castings, the major portions of the castings surfaces in contact with slurries are left in their as cast surface condition, which retains the mold sand imprint. Therefore, aside from the small smooth ground area at the ingate entry portion of each test block casting surface, the remainder of the casting surface was left in the as cast sand finish condition for the comparative corrosion tests hereinafter described.

Test blocks in the as cast condition from all test heats were immersed in 600 ml beakers containing various concentrations of sulfuric acid-water solutions for a period of six hours. Short glass rods were arranged at angles against the sides of beakers containing corrosion test solutions so that the corrosion test blocks could be placed in the solutions in such a fashion that all sides were in contact with the solutions. The immersions were then repeated twice for like periods in fresh solutions. Each test block was weighed to the nearest 1,000th of a gram both before and after the triple immersions and the weight loss was converted to a figure of average depth of corrosion penetration in mils per year, MPY, in accordance with the relationship:

$$MPY = 303.7 \frac{Wo - Wf}{ATD}$$

where

Wo=ORIGINAL WEIGHT OF SAMPLE
WF=FINAL WEIGHT OF SAMPLE
A=AREA OF SAMPLE IN SQUARE CENTIMETERS
T=DURATION OF THE TEST IN YEARS
D=DENSITY OF THE ALLOY IN GRAMS PER CUBIC CENTIMETER.

The results of these tests are set forth in Table IV.

TABLE IV

AVERAGE MPY LOSS IN VARIOUS SULFURIC ACID-WATER SOLUTIONS AT ROOM TEMPERATURE - AS CAST CONDITION

| | ACID CONCENTRATION - VOLUME PERCENT | | | | | |
|---|---|---|---|---|---|---|
| | 1.25% | 2.5% | 5% | 10% | 20% | 40% |
| ALLOYS OF THE INVENTION | | | | | | |
| H-995 | 18.2 | 16.8 | 25.4 | 43.3 | 16.1 | 64.8 |
| H-997 | 3.8 | 1.9 | 6.1 | 5.2 | 5.5 | 5.3 |
| H-1001 | 14.6 | 13.8 | 29.7 | 48.7 | 19.4 | 49.6 |
| H-1003 | 2.1 | 1.1 | 2.7 | 3.2 | 4.8 | 5.1 |
| H-1005 | 1.4 | 1.0 | 2.8 | 2.5 | 4.9 | 5.6 |
| H-1006 | 2.6 | 1.4 | 4.3 | 5.3 | 5.4 | 4.4 |
| H-1007 | 3.3 | 2.5 | 5.5 | 6.6 | 6.8 | 9.2 |
| H-1008 | 4.6 | 3.9 | 8.1 | 9.5 | 23.4 | 41.7 |
| H-1008 | 4.6 | 3.9 | 8.1 | 9.5 | 23.4 | 41.7 |
| H-1009 | 2.1 | 1.1 | 2.7 | 5.1 | 3.4 | 3.2 |
| H-1010 | 4.7 | 3.5 | 5.2 | 9.4 | 16.9 | 12.8 |
| H-1011 | 1.8 | 1.0 | 1.4 | 2.3 | 1.9 | 1.8 |
| H-1012 | 4.6 | 3.4 | 4.8 | 7.8 | 13.7 | 10.3 |
| H-1013 | 1.8 | 1.0 | 3.1 | 3.7 | 2.8 | 2.9 |
| H-1014 | .2 | .2 | .7 | .8 | .9 | 1.2 |
| ALLOYS NOT OF THE INVENTION | | | | | | |
| PACE | 120.2 | 173.8 | 282.5 | 482.2 | 1120.5 | 2556.9 |
| Niu | 75.7 | 78.3 | 92.8 | 361.3 | 735.3 | 1040.3 |
| CF177HiCr | 343.0 | 247.9 | 213.3 | 443.2 | 752.4 | 1641.8 |
| H-987 | 138.1 | 172.6 | 170.0 | 224.3 | 409.8 | 1020.2 |

From the results of these tests the pronounced beneficial effect of including 0.75% or more copper in the formulation of the alloys is clear. It is also evident that none of the comparative alloys is suitable in the as cast state for service in any concentration of sulfuric acid.

EXAMPLE 3

Alloy H-995, the comparative alloys and the copper-bearing alloys of the invention, all in the heat treated condition, were then tested in the same manner as in Example 2 above, in various sulfuric acid-water solutions. The results of these tests are set forth in Table V.

TABLE V

AVERAGE MPY LOSS IN VARIOUS SULFURIC ACID-WATER SOLUTIONS AT ROOM TEMPERATURE - HEAT TREATED CONDITION

| | ACID CONCENTRATION - VOLUME PERCENT | | | | | |
|---|---|---|---|---|---|---|
| | 1.25% | 2.5% | 5% | 10% | 20% | 40% |
| ALLOYS OF THE INVENTION | | | | | | |
| H-995 | 15.4 | 14.0 | 26.7 | 91.5 | 121.0 | 90.2 |
| H-997 | 3.0 | 5.4 | 2.4 | 7.2 | 5.5 | 4.1 |
| H-1003 | 2.4 | 1.6 | 2.3 | 3.6 | 4.6 | 5.0 |
| H-1005 | 2.8 | 2.1 | 1.8 | 2.6 | 4.6 | 3.7 |
| H-1006 | 3.1 | 5.8 | 2.8 | 6.5 | 4.7 | 3.9 |
| H-1009 | 2.5 | 1.8 | 2.5 | 2.9 | 4.8 | 5.1 |
| H-1011 | 1.8 | 4.7 | 4.2 | 6.4 | 4.3 | 4.2 |
| H-1013 | 2.2 | 1.4 | 2.8 | 3.4 | 2.6 | 2.6 |
| H-1014 | .2 | .3 | .6 | .8 | .8 | 1.4 |
| ALLOYS NOT OF THE INVENTION | | | | | | |
| PACE | 42.3 | 58.7 | 87.1 | 481.8 | 959.5 | 2556.9 |
| Niu | 83.2 | 79.6 | 88.8 | 421.5 | 816.7 | 1305.2 |
| CF177HiCr | 357.6 | 199.3 | 248.6 | 476.3 | 698.5 | 1501.8 |
| H-987 | 146.2 | 177.1 | 247.9 | 403.8 | 642.3 | 1346.2 |

From the above data, it is evident that the PACE alloy, heat treated in accordance with U.S. Pat. No. 4,536,232, was somewhat improved in corrosion resistance over the as cast alloy for 1.25% and 2.5% sulfuric acid strengths but that in stronger acid solutions, even the heat treated PACE alloy was too severely attacked to have practical application. The CF177 HiCr alloy and the Niu alloy suffered about the same attack in the heat treated condition as in the as cast condition. The H-987 alloy was cast to determine if increasing Ni and Mo contents of the PACE type alloy had any beneficial effect on the corrosion resistance of sulfuric acid solutions. Results in both the as cast and the heat treated condition were inferior to the PACE alloy in all of the sulfuric acid solutions.

EXAMPLE 4

Inasmuch as the plain high carbon high chromium irons serve quite well in strongly oxidizing nitric acid, alloys of the present invention were tested in 10%, 35% and 60% nitric acid solutions to determine if they could resist this acid even though the alloys were formulated specifically to resist sulfuric acid.

As cast and heat treated samples of several alloys of the invention and of the comparative alloys were tested in nitric acid in the same manner as in the examples above. Since high molybdenum contents often reduce alloy resistance in nitric acid, of the invention whose molybdenum contents were below 3.5%, along with the H-1014 alloy (6.22% Mo) were tested in nitric acid. The results of these tests are set forth in Table VI.

TABLE VI

AVERAGE MPY LOSS IN NITRIC ACID-WATER SOLUTIONS AT ROOM TEMPERATURE - AS CAST AND HEAT TREATED CONDITIONS

| | ACID CONCENTRATION - VOLUME PERCENT | | | | | |
|---|---|---|---|---|---|---|
| | AS CAST CONDITION | | | HEAT TREATED CONDITION | | |
| | 10% | 35% | 60% | 10% | 35% | 60% |
| ALLOYS OF THE INVENTION | | | | | | |
| H-995 | 8.9 | 1.0 | 19.6 | 7.6 | 3.4 | 16.5 |
| H-997 | 5.4 | 1.0 | 6.8 | 6.2 | 2.5 | 7.7 |
| H-1001 | 5.1 | 1.1 | 5.3 | 4.8 | 1.9 | 4.7 |
| H-1003 | 7.8 | 2.3 | 8.3 | 6.6 | 1.9 | 7.2 |
| H-1006 | 6.3 | 2.4 | 6.8 | 5.8 | 2.6 | 6.4 |
| H-1007 | 5.5 | 1.8 | 5.7 | 4.8 | 3.1 | 4.7 |
| H-1009 | 5.2 | 1.0 | 4.9 | 4.4 | 2.4 | 5.1 |
| H-1011 | 6.1 | 1.4 | 6.3 | 5.8 | 2.6 | 6.1 |
| H-1013 | 3.9 | 1.1 | 5.1 | 4.2 | 3.3 | 4.8 |
| H-1014 | 24.8 | 17.9 | 23.8 | 26.8 | 18.4 | 24.3 |
| ALLOYS NOT OF THE INVENTION | | | | | | |
| PACE | 24.5 | 15.8 | 15.5 | 33.6 | 13.7 | 17.9 |
| H-987 | 21.6 | 11.2 | 20.4 | 24.8 | 13.9 | 26.2 |
| Niu | 24.6 | 13.7 | 23.4 | 27.6 | 16.9 | 31.3 |
| CF177HiCr | 3.3 | 1.0 | 4.3 | 2.8 | 2.2 | 3.6 |

The alloys of the invention of less than 3.5% Mo and CF177 HiCr alloy all demonstrated good resistance to the different nitric acid strengths regardless of as cast or heat treated condition. The detrimental effect of high molybdenum content is reflected in the poor results of alloy H-1014 in all acid strengths. Alloy H-995 had the lowest chromium content and poorest results of all other alloys of the invention tested in the nitric acid. The austenitic Niu alloy, which has low matrix chromium content, also gave poor results in the nitric acid. The PACE alloy and somewhat similar H-987 alloy did not resist the nitric acid solutions well.

EXAMPLE 5

Several samples of the instant alloys were tested in the same manner as in the above examples in 10% sodium hydroxide, 10% ammonium nitrate and 10% phosphoric acid. The results of these tests are set forth in Table VII.

TABLE VII

AVERAGE MPY LOSS IN SEVERAL SOLUTIONS AT ROOM TEMPERATURE - AS CAST AND HEAT TREATED CONDITION

| ALLOY DESIGNATION | 10% SODIUM HYDROXIDE | 10% AMMONIUM NITRATE | 10% PHOSPHORIC ACID |
|---|---|---|---|
| AS CAST CONDITION | | | |
| H-995 | 4.3 | 2.8 | 8.2 |
| H-1003 | 3.7 | 4.6 | 3.6 |
| H-1005 | 2.4 | 3.3 | 5.2 |
| H-1006 | 1.6 | 5.2 | 4.1 |
| H-1007 | 4.1 | 3.9 | 2.8 |
| H-1009 | 1.8 | 6.1 | 3.9 |
| H-1011 | 3.3 | 2.2 | 4.1 |
| H-1013 | 2.7 | 3.3 | 3.6 |
| HEAT TREATED CONDITION | | | |
| H-997 | 5.2 | 3.3 | 6.4 |
| H-1003 | 2.8 | 4.2 | 4.9 |
| H-1005 | 4.1 | 3.4 | 4.8 |
| H-1006 | 3.2 | 4.2 | 5.2 |
| H-1007 | 3.1 | 2.7 | 3.2 |
| H-1009 | 3.6 | 4.6 | 2.6 |
| H-1013 | 1.9 | 3.9 | 1.6 |

It is apparent from the above tests that the alloys of the invention accomplish the desired objectives. Because of their properties, the instant alloys could also, for example, be used in iron ore pellet grates or similar high temperature applications requiring good resistance to high temperature abrasion, hot corrosion or oxidation and some mechanical and thermal shock.

In view of the above, it will be seen that the several objects of the invention are achieved.

Although specific examples of the present invention are provided herein, it is not intended that they are exhaustive or limiting of the invention. These illustrations and explanations are intended to acquaint others skilled in the art with the invention, its principles, and its practical application, so that they may adapt and apply the invention in its numerous forms, as may be best suited to the requirements of a particular use.

What is claimed:

1. An alloy consisting essentially of:

| | |
|---|---|
| CHROMIUM | 25 TO 37% BY WEIGHT |
| NICKEL | 12 TO 35% |
| MOLYBDENUM | 2 TO 7% |
| CARBON | 1.3 TO 2% |
| MANGANESE | UP TO ABOUT 4% |
| SILICON | UP TO ABOUT 3% |
| COPPER | UP TO ABOUT 3% |
| PHOSPHORUS | UP TO ABOUT 0.4% |
| IRON | ESSENTIALLY THE BALANCE |

2. An alloy of claim 1 further containing:

| | |
|---|---|
| TUNGSTEN | UP TO ABOUT 1.5% BY WEIGHT |
| NIOBIUM | UP TO ABOUT 1% |
| COBALT | UP TO ABOUT 1.5% |

3. An alloy of claim 1 consisting essentially of:

| | |
|---|---|
| CHROMIUM | 25 TO 30% BY WEIGHT |
| NICKEL | 12 TO 17% |
| MOLYBDENUM | 2 TO 4% |
| CARBON | 1.4 TO 1.8% |
| MANGANESE | UP TO ABOUT 4% |
| SILICON | UP TO ABOUT 2.5% |
| PHOSPHORUS | UP TO ABOUT 0.4% |
| IRON | ESSENTIALLY THE BALANCE |
| COPPER | UP TO ABOUT 3% |

4. An alloy of claim 2 consisting essentially of:

| | |
|---|---|
| CHROMIUM | 26 TO 30% BY WEIGHT |
| NICKEL | 13 TO 35% |
| MOLYBDENUM | 2 TO 4% |
| CARBON | 1.4 TO 1.8% |
| COPPER | 0.75 TO 3% |
| MANGANESE | UP TO ABOUT 2% |
| SILICON | UP TO ABOUT 2.5% |
| COBALT | UP TO 1.5% |
| TUNGSTEN | UP TO 1.5% |
| NIOBIUM | UP TO 1% |
| PHOSPHORUS | UP TO ABOUT 0.25% |
| IRON | ESSENTIALLY THE BALANCE |

5. An alloy of claim 1 consisting essentially of:

| | |
|---|---|
| CHROMIUM | 32 TO 37% BY WEIGHT |
| NICKEL | 21 TO 30% |
| MOLYBDENUM | 3 TO 6% |
| COPPER | UP TO 1% |
| NIOBIUM | UP TO 1% |
| TUNGSTEN | UP TO 1% |
| MANGANESE | UP TO 1.5% |
| SILICON | UP TO 1.5% |

-continued

| | |
|---|---|
| CARBON | 1.4 TO 1.8% |
| PHOSPHORUS | UP TO ABOUT 0.25% |
| IRON | ESSENTIALLY THE BALANCE |

6. An alloy of claim 1 wherein the copper content is at least about 0.75% by weight.

7. An alloy of claim 1 wherein the molybdenum content is not greater than about 3.5% by weight.

8. An alloy of claim 6 wherein the molybdenum content is not greater than about 3.5% by weight.

9. An alloy of claim 2 wherein the phosphorus content is from about 0.1% to about 0.25% by weight.

10. An alloy of claim 1 consisting essentially of:

| | |
|---|---|
| CHROMIUM | ABOUT 28% BY WEIGHT |
| NICKEL | ABOUT 12% |
| MOLYBDENUM | ABOUT 2% |
| CARBON | ABOUT 1.5% |
| MANGANESE | ABOUT 4% |
| SILICON | ABOUT 0.35% |
| COPPER | ABOUT 1% |
| PHOSPHORUS | ABOUT 0.23% |
| IRON | ESSENTIALLY THE BALANCE |

11. An alloy of claim 1 consisting essentially of:

| | |
|---|---|
| CHROMIUM | ABOUT 34-35% BY WEIGHT |
| NICKEL | 21-22% |
| MOLYBDENUM | ABOUT 2% |
| CARBON | ABOUT 1.5% |
| MANGANESE | 1-3.3% |
| SILICON | 0.6-0.75% |
| COPPER | 1.7-2.8% |
| PHOSPHORUS | ABOUT 0.15% |
| IRON | ESSENTIALLY THE BALANCE |

12. An alloy of claim 1 wherein the phosphorus content is up to about 0.025% maximum.

13. An alloy of claim 3 wherein the phosphorus content is up to about 0.025% maximum.

14. An alloy of claim 1 consisting essentially of:

| | |
|---|---|
| CHROMIUM | ABOUT 27% BY WEIGHT |
| NICKEL | ABOUT 13.5% |
| MOLYBDENUM | ABOUT 2.25% |
| CARBON | ABOUT 1.7% |
| MANGANESE | ABOUT 0.5% |
| SILICON | ABOUT 1% |
| COPPER | ABOUT 1% |
| PHOSPHORUS | ABOUT 0.025% max |
| IRON | ESSENTIALLY THE BALANCE |

* * * * *